US005595786A

United States Patent [19]

McBride, Jr. et al.

[11] Patent Number: 5,595,786

[45] Date of Patent: Jan. 21, 1997

[54] METHOD OF PREPARING SURFACE FOR RECEIVING A COATING AND APPARATUS THEREFOR

[75] Inventors: John S. McBride, Jr.; Kenneth J. O'Connor, both of Spartanburg, S.C.

[73] Assignee: Contec, Inc. of Spartanburg, Spartanburg, S.C.

[21] Appl. No.: 484,872

[22] Filed: Jun. 7, 1995

[51] Int. Cl.[6] ..... B05D 3/00; B05D 3/12

[52] U.S. Cl. ..... 427/299; 134/40; 206/233; 206/494; 206/812; 221/33; 221/63; 221/135; 427/322; 427/327; 427/424

[58] Field of Search ..... 134/38, 40; 206/233, 206/494, 812; 221/33, 63, 135; 427/299, 307, 308, 322–4, 326, 444, 327, 424

[56] References Cited

U.S. PATENT DOCUMENTS 2,199,712 5/1940 Neilson ..... 134/40 X 4,679,693 7/1987 Forman ..... 206/610

5,259,984 11/1993 Hull ..... 134/40 X

FOREIGN PATENT DOCUMENTS 488967 6/1992 European Pat. Off. ..... 221/33

406048475 2/1994 Japan ..... 221/33

*Primary Examiner*—Michael Lusignan

*Attorney, Agent, or Firm*—Dority & Manning

[57] ABSTRACT

Contaminants are removed from a surface being prepared to receive a finish coating or a treatment. Solvent is applied manually to the surface with carrier sheets dispensed from reclosable packages where the solvent is contained along with a plurality of quarter-folded carrier sheets formed from non-woven material. The packages can be grounded to reduce the incidence of static electrical build-up.

6 Claims, 4 Drawing Sheets

METHOD OF PREPARING SURFACE FOR RECEIVING A COATING AND APPARATUS THEREFOR

BACKGROUND OF THE INVENTION

The present invention relates to methods and apparatus for preparing a contaminated surface to receive a coating intended to be adhered to the surface and more particularly to methods and apparatus for removing contaminants from a surface intended to receive a finish coating such as paint.

The manufacture of articles that require the application of a finishing coating (such as paint) to the article, typically requires the removal of contaminants from the article's surface before the finish coat is applied to the article's surface. For example, in an automotive assembly line, workers rub down the exterior of the vehicle body with solvents that remove contaminants prior to sending the vehicle body to be painted. Typically, the containers dispensing the solvents are mounted on pivots so that the workers can hold a rag at the mouth of the container while tipping the container so as to dispense the solvent onto the rag. The worker then manually rubs the surface with the solvent-soaked rag to remove the contaminants from the surface of the vehicle that is to be painted.

These liquid solvents are compositions that include volatile organic compounds (VOC's) such as isopropyl alcohol and naptha, as well other materials such as deionized or purified water. The solvent compositions typically include other ingredients such as dipropylene glycol monomethylether (DPM). These compositions usually are mixed by the workers themselves, and the particular formulation is chosen depending upon the type of finish coating that is to be applied to the surface of the vehicle. For example, if a water-based paint is to be applied, the main solvent ingredient is isopropyl alcohol. For a solvent-based paint, the main solvent is naptha. However, controlling the proportion of these main ingredients in the solvent composition used by the workers can become problematic as such control becomes based on the skill of the worker who prepares the solvent composition. Similarly, the amount of solvent applied to the surface by the worker with the wiper that the worker has soaked with solvents dispensed from the pivoting container mouth is difficult to control. The control of these factors is desirable from the standpoints of the cost of the solvents, the effectiveness of their application to the surface for removing contaminants, and minimizing the solvent concentration in the atmosphere of the workers' environment. The latter involves both the health of the workers who are breathing this atmosphere and the safety of the workers in an environment where volatile liquids such as solvents may pose a fire hazard. Additionally, it is well known that reducing VOC's released to the atmosphere poses a positive impact on the environment.

Resealable dispensers of wipers saturated with VOC's are known, and one type is shown in FIG. 1 is described as follows. A resealable thin package, generally indicated by the numeral 10, includes a top panel 12 disposed opposite a bottom panel (not visible) and joined to one another at their peripheral edges 14 as by heat sealing and forming a receptacle 15 therebetween. Each of the top and bottom panels is composed of an outer layer formed of a sheet of polyester material that is contact-laminated to an inner layer formed of a sheet of polyethylene material. The top panel is provided with an elongated through-cut 16 that forms a flap 18, which remains attached to top panel 12 by a hinged portion 20 and reveals an opening 17 through top panel 12. A resealable cover 22 has a lower surface 24 disposed opposite an upper surface 26, which is configured and composed to receive printing (not shown) thereon. Cover 22 is configured and disposed to overlie and cover through-cut 16, opening 17, and flap 18. Lower surface 24 of cover 22 is provided with adhesive (indicated by stippling) 28 that permits cover 22 to be peeled away from top panel 12 and thereafter reseal the opening 17 defined through top panel 12 by through-cut 16. A plurality of knitted sheets 30 are stacked in the receptacle 15. A volatile organic compound is provided in receptacle 15 and saturates sheets 30. Such packages 10 have been used in health care environments, biological lab environments, "clean room" environments such as in semiconductor manufacturing, and other sterile environments. Other dispensing packages such as the package formed by a machine manufactured by the Hayssen Corporation, are configured having a polyester/polyethylene laminated sheet, which is wrapped about a stack of nonwoven wipers and sealed at three locations, at its opposite ends and lengthwise where the edges overlap.

OBJECTS AND SUMMARY OF THE INVENTION

The present invention recognizes and addresses the foregoing considerations, and others of prior art constructions and methods.

It is a principal object of the present invention to provide improved method and apparatus for the use of solvents to remove contaminants from a surface before a finish coating is applied to the surface.

It is another principal object of the present invention to provide improved method and apparatus for applying volatile organic compounds (VOC's) in a manufacturing work environment.

It is a further principal object of the present invention to provide improved method and apparatus that reduces the volatile organic compound content of the atmospheric environment of workers who are using VOC's to remove contaminants from surfaces before a finish coating is to be applied to such surfaces.

Yet another principal object of the present invention is to provide improved method and apparatus for improving the safety of the environment where workers are using VOC's to remove contaminants from surfaces before a finish coating is applied to such surfaces.

Still another principal object of the present invention is to provide method and apparatus for improving the efficiency with which workers apply VOC's to remove contaminants from surfaces before a finish coating is applied to such surfaces.

Yet another principal object of the present invention is to provide improved method and apparatus that reduces the amount of VOC's used by workers to remove contaminants from surfaces before a finish coating is applied to such surfaces, lessening the amount of VOC's released into the environment, without reducing, or even enhancing, the ability to remove the contaminants that need to be eliminated from such surfaces.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method is provided for preparing a surface for receiving a treatment or coating. The method includes the step of providing a flexible resealable package containing a solvent together with a plurality of solvent carriers in the form of sheet members composed of material carrying the solvent. At least one of the carriers of the solvent is removed from the package. Desirably, the package is grounded before the carriers are removed. The removed carrier is used to apply the solvent to the surface. Desirably, the used carrier is placed into a covered receptacle so as to diminish evaporation of the solvent into the atmosphere.

An apparatus suitable for dispensing a plurality of carrier sheets containing at least one volatile solvent includes a top panel and a bottom panel, each having an outer surface and an inner surface. Desirably, for both the top and bottom panels, the outer surface is formed of a polyester sheet, while the inner surface is formed of a polyethylene sheet that is contact-laminated to the polyester sheet. The top panel being is joined at its edges to the bottom panel at the bottom panel's edges to form a cavity therebetween. The top panel is configured with an elongated through-cut defining a hinged flap. The package is provided with a door member configured and disposed to overlie and completely cover the through-cut in the top panel. Desirably, the door member has an inner surface provided with an adhesive, which permits the door member to be repeatedly raised manually from the outer surface of the top panel and re-adhered to the outer surface of the top panel. Desirably, the door member also has an outer surface disposed opposite the inner surface and configured to readily accept printing thereon.

A plurality of carrier sheets which are folded into quarters or a similar configuration are disposed in the cavity formed between the top and bottom panels, each of the carrier sheets being composed of a non-woven sheet. At least one solvent is absorbed within each of the carrier sheets. Desirably, at least one metallized strip may be integrated with least one of the top and bottom panels to provide grounding.

In an alternative embodiment, a generally tubular sheeting member is provided with an open end disposed opposite a closed end. The sheeting member defines an outer surface and an inner surface disposed opposite the outer surface. The inner surface defines a cavity internally of the tubular sheeting member. At least one carrier sheet is disposed in the cavity and carrying at least one solvent. A reclosable closure member is disposed to close the open end of the tubular sheeting member.

Other objects, features and aspects of the present invention are discussed in greater detail below. The accompanying drawings, which are incorporated in and constitute a part of this specification, illustrate preferred embodiments of the invention and, together with the description, serve to explain the principles of the invention.

Figure 1:
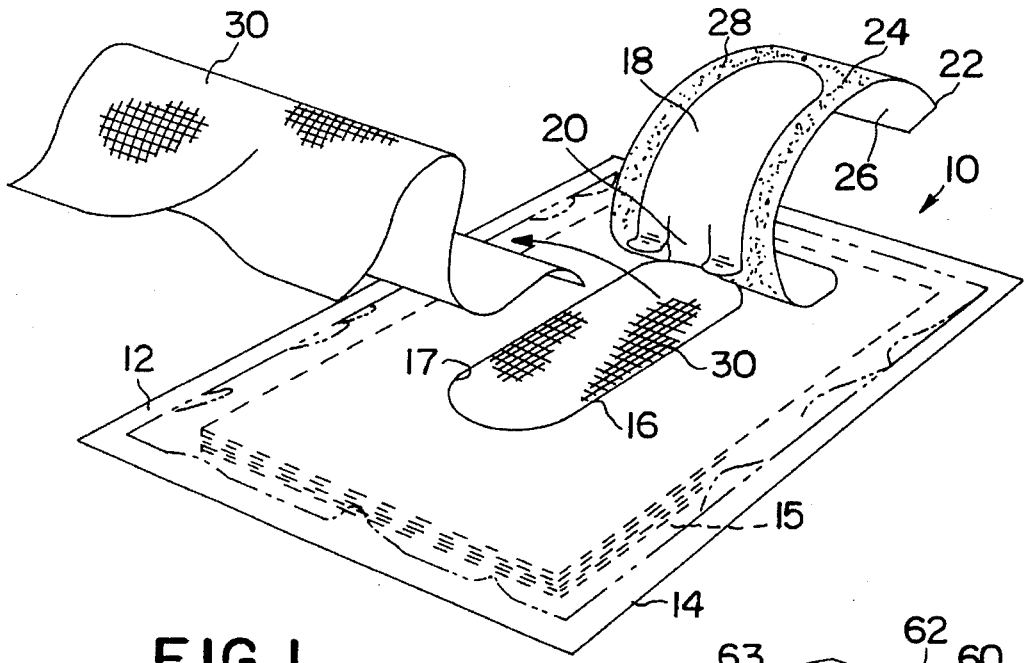
FIG. 1 PRIOR ART
FIG. 1 is an elevated perspective view of a prior art apparatus.

Repeat use of reference characters in the present specification and drawings is intended to represent same or analogous features or elements of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

Figure 2:
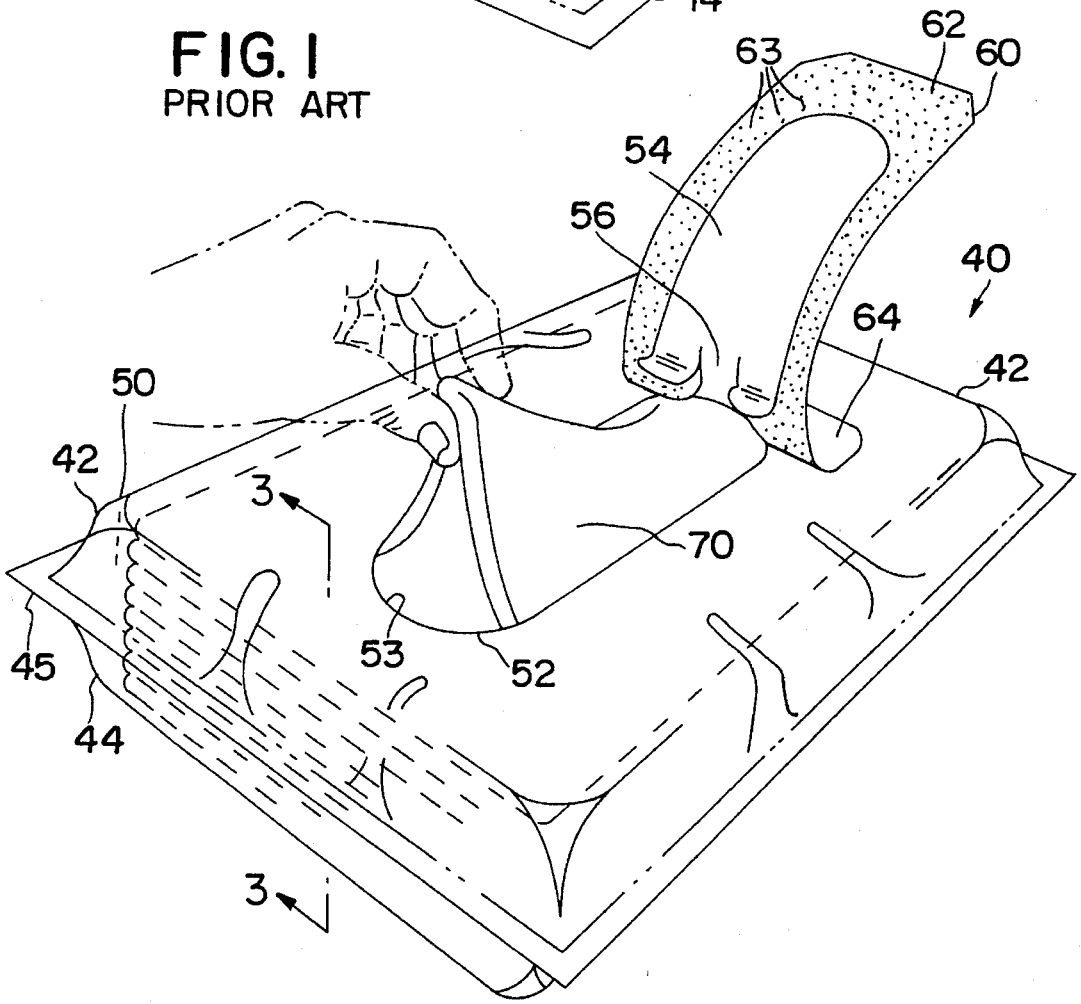
FIG. 2 is an elevated perspective view of a preferred embodiment of an apparatus in accordance with the present invention.
Figure 3:
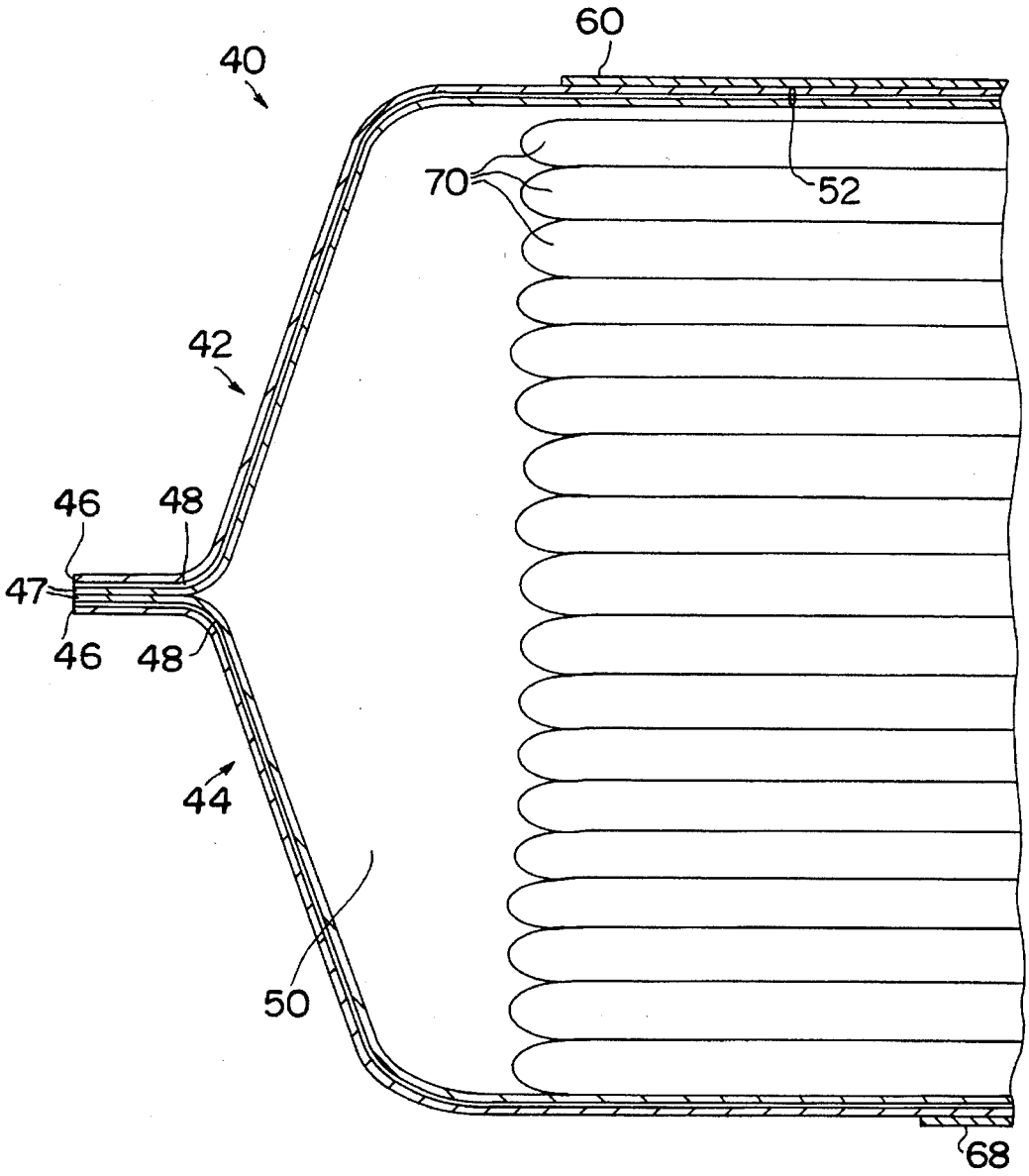
FIG. 3 is a cross-sectional view taken along the lines 3—3 of FIG. 2.

In accordance with the present invention, an apparatus is provided for storing and dispensing a plurality of carrier sheets containing at least one volatile solvent. A preferred embodiment of a dispensing package of the present invention is shown in FIG. 2 and is represented generally by the numeral 40. The package 40 is defined by a top panel 42 disposed opposite a bottom panel 44 and joined to one another at their peripheral edges 45 as by heat sealing and forming a storage cavity 50 therebetween. As shown in FIG. 3, each of the top and bottom panels 42, 44 is composed of an outer layer 46 formed of a sheet of polyester material that is contact-laminated with an adhesive layer 48 to an inner layer 47 formed of a sheet of polyethylene material. Thus, storage cavity 50 is defined by top and bottom polyethylene layers 47. As shown in FIG. 2, the top panel is provided with an elongated through-cut 52 that forms a flap 54, which remains attached to top panel 42 by a hinged portion 56 and reveals an access opening 53 through top panel 42.

Figure 4:
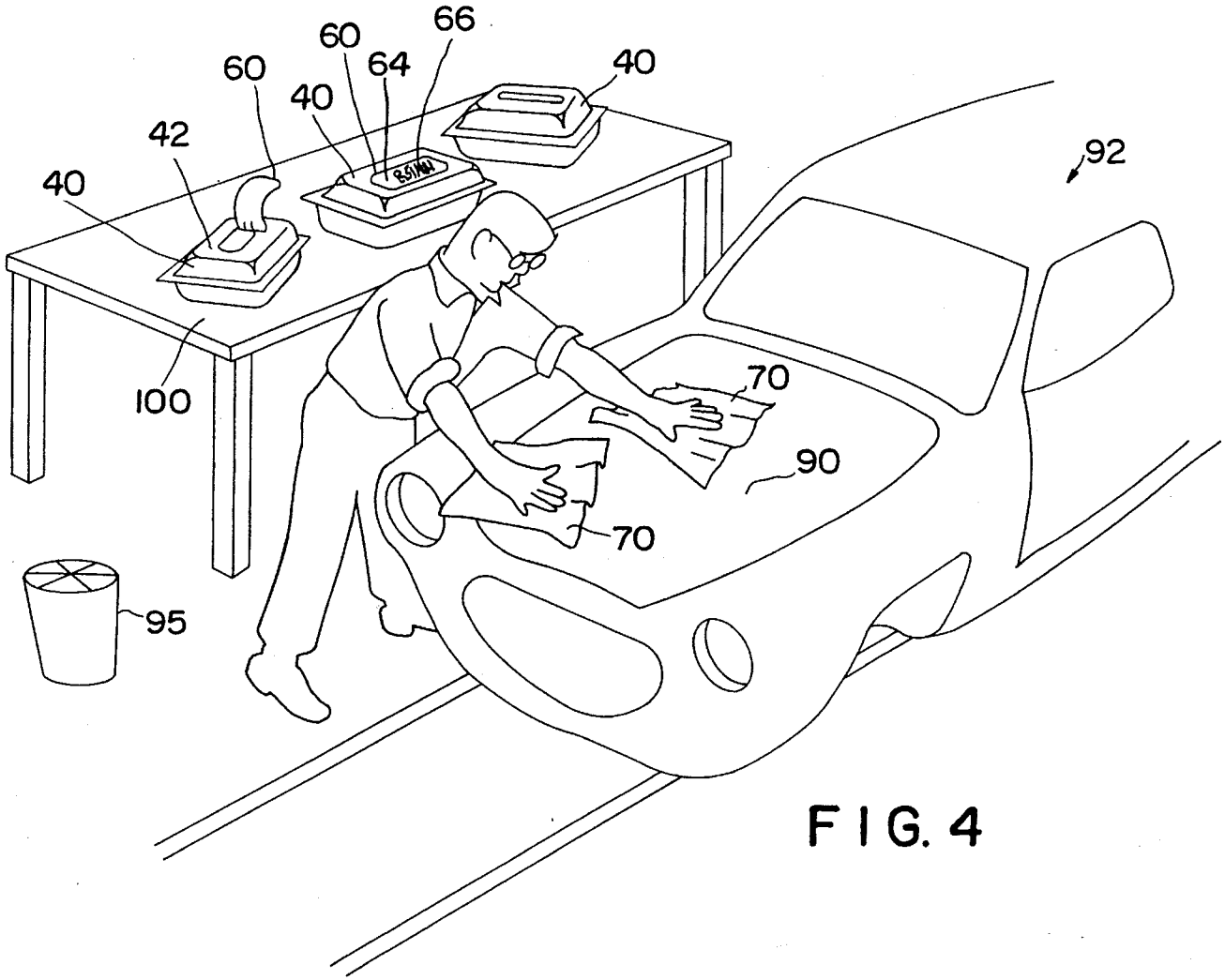
FIG. 4 is an elevated perspective view illustrative of the method in accordance with the present invention.

A resealable door member 60 has an inner surface 62 disposed opposite an outer surface 64, which is configured and composed to receive printing 66 (FIG. 4) thereon so that it may also serve as a label identifying the package and its contents. Door member 60 is configured and disposed to overlie and cover through-cut 52, access opening 53, and flap 54. Inner surface 62 of door member 60 is provided with adhesive (indicated by stippling) 63 that permits door member 60 to be peeled away repeatedly from top panel 42 and thereafter repeatedly reattached to top panel to reseal the access opening 53 defined through top panel 42 by through-cut 52.

A plurality (30 to 50) of carrier sheets 70 are stacked in the cavity 50. Each carrier sheet desirably is a non-woven sheet formed of melt-blown polypropylene. As shown in FIGS. 2 and 3 for example, each sheet 70 is stored in cavity 50 after having been folded in half and in half again, i.e., quarter-folded. In the embodiment shown, therefore, eight work surfaces are provided which can be used separately and sequentially.

The size of each work surface after folding is preferably slightly larger than the hand of a user. Because the work surface is larger than the user's hand, oil or contaminants on the hand will not contact the surface to be cleaned. For example, a 16"×17" sheet may be quarter-folded to yield eight work surfaces, each of which measures approximately 8×8.5 inches. It should be appreciated, however, that a different number of folds may be provided depending on the initial size of the overall sheet.

After carrier sheets 70 are disposed in cavity 50, a volatile organic compound (VOC) is injected into cavity 50 and saturates sheets 70. Handling, shipment and storage of the sealed packages 40 tends to disperse the VOC's uniformly throughout each carrier sheet 70. Additionally, certain non-woven materials may be utilized which are known to have properties that enhance the uniform saturation of the VOC's through the product's shelf life.

Figure 5:
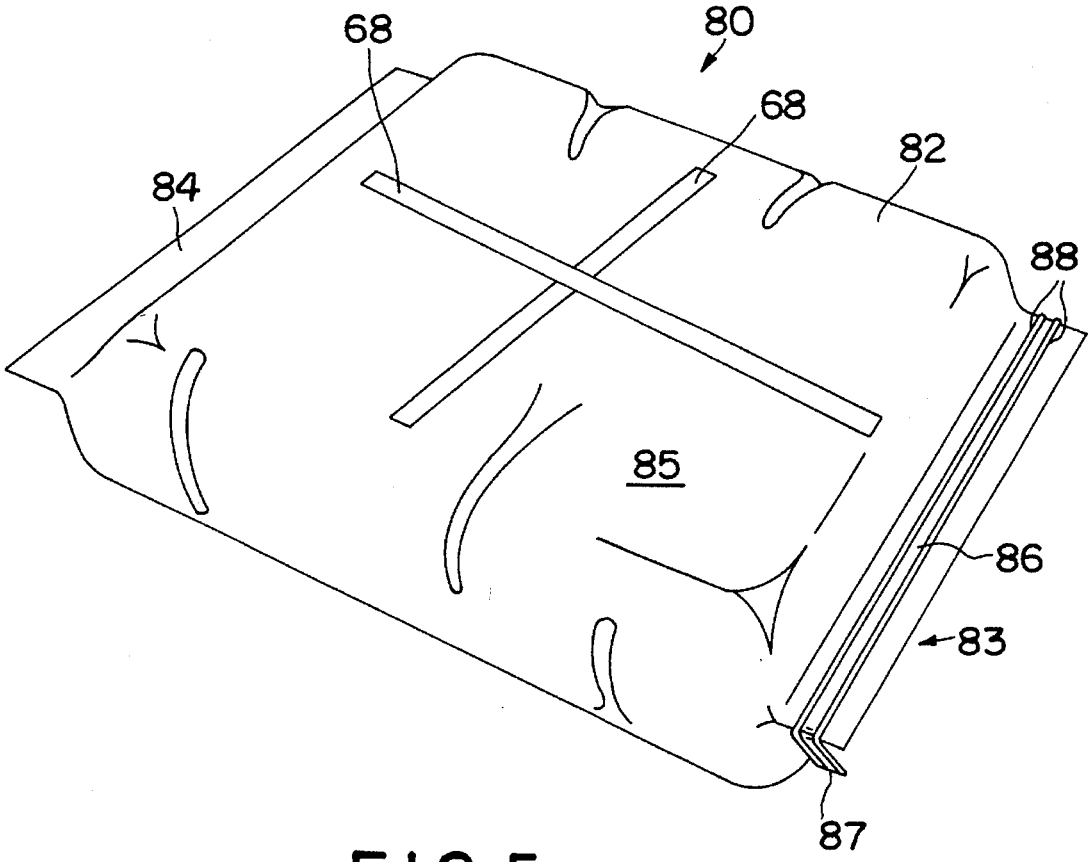
FIG. 5 is an elevated perspective view showing an alternative embodiment in accordance with the apparatus of the present invention.

In an alternative embodiment shown in FIG. 5 for example, a package 80 is formed of a generally tubular sheeting member 82 having an open end, generally 83 in FIG. 5, disposed opposite a closed end 84. Sheeting member 82 desirably is formed of nylon, which does not degrade in the presence of naptha. Sheeting member 82 defines an outer surface 85 and an inner surface defining a cavity internally of tubular sheeting member 82. A plurality of carrier sheets like those designated 70 shown in FIGS. 2 and 3 are disposed for storage within the cavity formed internally of tubular sheeting member 82. At least one solvent is injected into the cavity defined by the inner surface of package 80. This solvent can be provided in the form of a composition with other ingredients, as desired. Typically, naptha is the solvent used when tubular sheeting member 82 is formed of nylon.

As shown in FIG. 5, open end 83 of tubular sheeting member 82 is closed by providing a reclosable closure member 86. Desirably, closure member 86 is formed from a pair of elongated deformable wire members 88 encased in a flexible plastic coating so that the ends 87 of closure member 86 can be folded back around a surplus of tubular sheeting member 82 near open end 83 of package 80. When ends 87 are closed back upon closure member 86, closure of open end 83 is effected.

In accordance with the present invention, at least one metallized strip is integrated into a surface of the package, wherein such surface is configured and intended to ground the package. As shown in FIG. 5 for example, two elongated metallized strips 68 are attached to the exterior of package 80. Each metallized strip 68 is intended to ground the package to reduce the incidence of a build-up of static electrical charge on the package 80. This reduces the risk of accidental electrical discharge and possible ignition of volatile organic compounds in the vicinity of the package.

While the embodiment shown in FIG. 5 illustrates grounding strip 68 on the exterior of package 80, it could also be attached to the interior or embedded within one of the panels depending on the dielectric properties of such panel. In other words, if the panel may function as a suitable conductor, the strip may be placed on the inside of the package or embedded in the panel and still achieve adequate grounding.

In accordance with the present invention, a method is provided for preparing a surface for receiving a treatment or a coating that is to be adhered to such surface. As embodied herein and shown in FIG. 4 for example, the method includes providing a flexible resealable package containing a solvent in liquid form together with a plurality of solvent carriers in the form of sheet members, which are composed of material that carries the solvent. In the example illustrated in FIG. 4, the exterior metal surface 90 of a vehicle 92 is being prepared to be painted. An assembly-line worker removes a quarter-folded non-woven sheet 70 of melt-blown polypropylene saturated with a composition including a volatile organic compound. The worker manually rubs the carrier sheet 70 against the surface 90 to remove contaminants from this surface. After using the carrier sheet 70, the worker desirably discards it into a covered receptacle 95. Desirably, when the worker needs another carrier sheet, the worker lifts the door member 60 of the resealable package 40, removes a carrier sheet 70, and reseals the package by lowering the door member and pressing it against the top panel 42 of the package so that the adhesive on the inner surface of the door member adheres to the top panel of the package. This prevents VOC's from evaporating into the atmosphere in the work environment. Similarly, the worker could use closure member 86 to reseal package 80. Moreover, by placing discarded carrier sheets 70 into a covered receptacle 95, evaporation of the solvent into the atmosphere of the work environment is further diminished.

Desirably, precautions are taken to protect against static electrical discharges by grounding the packages 40, 80 containing the solvent-saturated carrier sheets 70. This can be accomplished by providing metallized strips 68 on the bottom panels of the packages, and placing the bottom panels with the metallized strips 68 on top of a metal table top 100.

The composition has been formulated according to, among other factors, the type of surface, the type of coating to be applied to the surface, and the contaminants to be encountered. For example, if a water-based paint is to be applied, the main solvent ingredient may be isopropyl alcohol. For a solvent-based paint, the main solvent is typically naptha. The material used in the package also can be chosen based on the predominant VOC used in the composition. For example, since naptha degrades the adhesive layer 48 used between the polyester layer 46 and polyethylene layer 47 of package 40, package 80 formed of nylon is used to contain naptha-based compositions.

Advantages of the method of the present invention include the elimination of spillage of solvent in the work environment. The dispersion of the solvent on the surface is more consistent using the carrier sheets stored in the resealable packages. This is because the solvent is more uniformly contained throughout the carrier sheet, rather than being concentrated in one or more parts of the carrier sheet. The solvent is more efficiently applied to the surface, thus resulting in less waste of the solvent. Since the solvent is already provided in the desired proportions within the resealable packages, a more consistent solvent composition is provided, than if the workers were to mix new batches themselves. In addition, the surface is cleaned as well as, and in many cases, better than when prior art techniques are utilized. Further, the amount of solvent that evaporates into the atmosphere of the work environment is drastically reduced, making the work environment safer and healthier.

While a preferred embodiment of the invention has been described using specific terms, such description is for illustrative purposes only, and it is to be understood that changes and variations may be made without departing from the spirit or scope of the following claims.

What is claimed is:

1. A method of preparing a surface of a motor vehicle for painting, the method comprising the steps of:

providing a resealable package containing a solvent together with a plurality of solvent carriers in the form of sheet members composed of material carrying said solvent;

removing at least one said carriers of said solvent from said package;

using said removed carrier to apply said solvent to the motor vehicle surface to prepare the motor vehicle surface for application of paint; and applying paint to the motor vehicle surface as part of a systematic painting of a plurality of motor vehicles.

2. A method as in claim 1, further comprising the step of:

grounding the package before removing any carriers from the package.

3. A method as in claim 1, further comprising the step of:

placing said used carrier into a covered receptacle so as to diminish evaporation of said solvent into the atmosphere.

4. A method as in claim 1, wherein:

said solvent is applied by rubbing said carrier over the surface.

5. A method as in claim 1, wherein:

said solvent is applied to remove contaminants from the surface.

6. The method as in claim 1, wherein said providing step includes providing a flexible resealable package.

* * * * *